US012560086B2

(12) United States Patent
Long et al.

(10) Patent No.: US 12,560,086 B2
(45) Date of Patent: Feb. 24, 2026

(54) LONG TAPERED RETAINER GROOVE ROAD PLANING BODY

(71) Applicant: Kennametal Inc., Latrobe, PA (US)

(72) Inventors: Thomas Long, Greensburg, PA (US); Arkadiusz Jan Dlugosz, Żory (PL)

(73) Assignee: KENNAMETAL INC., Latrobe, PA (US)

( * ) Notice: Subject to any disclaimer, the term of this patent is extended or adjusted under 35 U.S.C. 154(b) by 139 days.

(21) Appl. No.: 18/437,849

(22) Filed: Feb. 9, 2024

(65) Prior Publication Data

US 2025/0257656 A1 Aug. 14, 2025

(51) Int. Cl.
*E21C 35/197* (2006.01)

(52) U.S. Cl.
CPC ..... *E21C 35/197* (2013.01)

(58) Field of Classification Search
CPC ..... E21C 35/197
See application file for complete search history.

(56) References Cited

U.S. PATENT DOCUMENTS 4,850,649 A 7/1989 Beach et al.
6,824,225 B2 * 11/2004 Stiffler ..... E21C 35/197 299/105
2007/0090679 A1 4/2007 Ojanen
2015/0300166 A1 10/2015 Ries et al.
2016/0298453 A1 10/2016 Frederick

FOREIGN PATENT DOCUMENTS

DE 20119109 U1 * 4/2003 ..... E21C 35/197
GB 2182373 A 5/1987

OTHER PUBLICATIONS

"RPR 20mm Straight Retainer 050," S01, Drawing No. 62259932.000, Kennametal, Dec. 21, 2022, 1 Page.
"RPR06-T Retainer," S01, Drawing No. 2796271.001, Kennametal, Dec. 16, 2020, 1 Page.

* cited by examiner

*Primary Examiner* — Janine M Kreck
(74) *Attorney, Agent, or Firm* — John A. Wilaj, Jr.

(57) ABSTRACT

A retainer for a tool comprises an annular body, a plurality of protruding bosses, and a slot formed through the body in an axial direction. The annular body defines a central opening adapted to receive a tool therein in the axial direction and includes a first end having a first external diameter, and a second end having a second external diameter. The plurality of protruding bosses extend into the opening from an internal side of the body defining the central opening. In a resting state of the body, the first external diameter and the second external diameter are distinct from one another. The body is elastically deformable into a compressed state wherein the first external diameter and the second external diameter are equal.

19 Claims, 10 Drawing Sheets

LONG TAPERED RETAINER GROOVE ROAD PLANING BODY

FIELD OF THE INVENTION

The present disclosure relates to tool handling, and more specifically, to a tool retainer or road planing body and a tool assembly including said retainer.

BACKGROUND

In road planing or milling operations, a plurality of cutting tools may be secured to larger equipment (e.g., a rotating assembly of a road planing machine) adapted to engage the tooling with the pavement or working surface. In order to, for example, improve wear characteristics of the cutting tools, it may be desired to secure the tools to the equipment such that they are freely rotatable radially about their axis when in use, while remaining generally fixed in an axial direction relative to the equipment. According to the prior art, this partially or semi floating tool arrangement is achieved via a tool retainer. More specifically, the retainer is fitted over the tool (e.g., a shank thereof), and positively engages therewith in a manner which secures the tool in an axial direction, while permitting its rotation relative to the retainer. The retainer and tool are then installed into a bore of a tool holder or block which is attached to or formed integrally with the equipment. This may be achieved, for example, via a press fit between the retainer and the bore. Retainers of the prior art, however, suffer from one or more drawbacks. These many include, for example, insufficient holding or retention force, non-optimal retention characteristics, and unnecessarily difficult installation and/or removal processes.

SUMMARY

According to an embodiment of the present disclosure, a retainer for a tool comprises an annular body, a plurality of protruding bosses, and a slot formed through the body in an axial direction. The annular body defines a central opening adapted to receive a tool therein in the axial direction and includes a first end having a first external diameter, and a second end having a second external diameter. The plurality of protruding bosses extend into the opening from an internal side of the body defining the central opening. In a resting state of the body, the first external diameter and the second external diameter are distinct from one another. The body is elastically deformable into a compressed state wherein the first external diameter and the second external diameter are equal.

BRIEF DESCRIPTION OF THE DRAWINGS

The invention will now be described by way of example with reference to the accompanying Figures, of which.

DETAILED DESCRIPTION OF THE EMBODIMENTS

Figure 1:
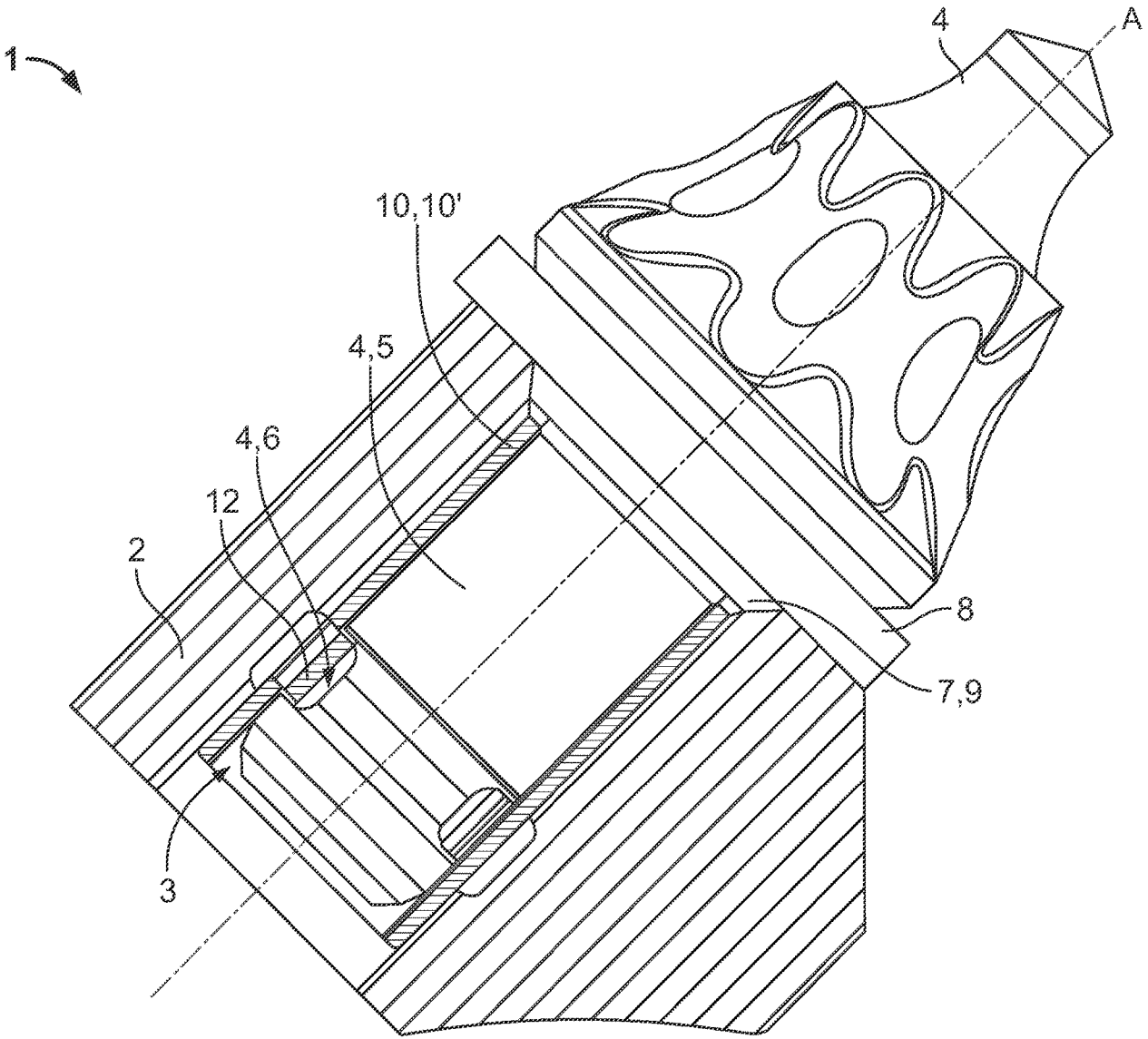
FIG. 1 is a partial cross-sectional view of a tool assembly useful for describing embodiments of a retainer according to the present disclosure, including a tool, a tool retainer, a compression element and a tool holder.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Embodiments of the present disclosure include a tool retainer or road planing body adapted to secure a tool (e.g., a shank of a road milling or cutting tool) within a tool holder or block. The retainer comprises a hollow annular body including a first end and a second end. The retainer is adapted to receive the tool, and be secured thereto such that relative movement between the tool and the retainer is limited at least in an axial direction of the retainer. A slotted opening or slot is defined through an annular wall the body and extends in an axial and/or longitudinal direction of the retainer between the first end and the second end. In one embodiment, in a resting or free state of the retainer (e.g., when no external forces are acting on the retainer) the first end of the retainer has a diameter greater than a second end of the retainer (or vice-versa). In this way, the body of the retainer is a shaped generally as a conical frustum. The axial slot formed through the body may likewise be tapered. Specifically, a width of the slot in a circumferential direction at the first end thereof is greater its width of the second end, corresponding the first end having a larger diameter and the second end having a smaller diameter, respectively (or vice-versa). In a second, working, or elastically compressed state of the retainer (i.e., after being installed into the bore of a tool holder), the body is deformed into a generally cylindrical shape, wherein the diameters of the first and second ends of the body are generally equal. Likewise, in this state the width of the slot in the circumferential direction may be generally constant along the axial length of the body.

In the second state, as a result of its inherent elastic return force, the retainer is operative to frictionally engage with the inner bore of the tool holder, securing the retainer and the tool engaged therewith within the tool holder or block.

In order to further facilitate tool retention, a plurality of bosses may be formed by the body. The bosses define protrusions extending into the hollow interior of the body in a radially inward direction. The bosses or protrusions are adapted to engage with a corresponding annular groove or recess formed in the shank of the tool for securing the tool within the retainer. More specifically, the bosses and corresponding groove may be adapted to oppose relative motion between the tool and the retainer in the axial direction, while permitting radial movement or rotation of the tool within the retainer.

Referring now to FIG. 1, a tool assembly 1 according to an exemplary embodiment of the present disclosure is shown in an installed, assembled, or working state. The assembly 1 includes a tool holder or block 2. The holder 2 may be formed integrally with or fixed to, for example, a rotating component of a road planing or milling machine, by way of non-limiting example. The holder 2 defines an opening or bore 3 (e.g., a generally cylindrical opening) adapted to receive a tool subassembly including a cutting tool 4 and a tool retainer 10, 10' therein.

The tool 4 is held within the bore 3 of the holder 2 via the retainer 10. More specifically, the retainer 10 is at least partially cylindrical and hollow in shape, and is fitted over a shank 5 of the tool 4 in an axial direction of insertion (i.e., along a central axis A of the assembly 1). The tool 4 defines an annular groove or recess 6 formed radially about the shank 5. In the exemplary embodiment, the groove 6 is formed proximate a first end of the tool 4, distal to its working end or cutting tip.

As will be set forth in greater detail, the retainer 10 includes one or more bosses 12 extending radially inward, and adapted to engage with the groove 6 of the tool 4 when the retainer is installed over the shank 5. The bosses 12 define axially facing surfaces opposing inner surfaces of the groove 6 in the axial direction. In this way, the bosses 12 and groove 5 cooperate to generally fix the tool 4 within the retainer 10, limiting or preventing axial movement therebetween. As can be visualized from the figure, due to the annular nature of the groove 6, the tool 4 remains generally rotatable within the retainer 10, with the bosses 12 slidably engaging within the groove 6 in a radial direction about the central axis A of the assembly 1.

As will be set forth in greater detail herein, in its free state, at least portions of the retainer 10 define an outer dimension or diameter greater than a diameter of the bore 3 of the holder 2. In this way, the retainer 10 is adapted to be elastically compressed radially inward upon insertion into the bore 3 of the holder 2. The resulting radially outward directed forces (i.e., elastic expansion forces) are applied by outer circumferential surfaces of the retainer 10 against an inner wall of the holder 2 defining the bore 3. The retainer 10 and the bore 3 are adapted (i.e., sized and shaped), such that these forces generate friction sufficient to secure the tool 4 and the retainer 10 within the holder 2 (i.e., prevent its axial translation).

As will be set forth in detail herein, in order to facilitate its insertion into the holder 2, the assembly 1 includes a compression element or washer 8 slidably fittable over the retainer 10. The compression element 8 includes a receiving opening sized to compress at least the portions of the retainer 10 in a radially inward direction, and reduce its outer diameter such that the retainer may be inserted into the bore 3. In the fully inserted or installed position shown in FIG. 1, the compression element 8 has been biased axially either past the retainer 10, or at least substantially toward the second end 16 thereof. As a result, the retainer 10 is permitted to elastically expand, generating the above described friction forces with the bore 3 of the holder 2.

Figure 2:
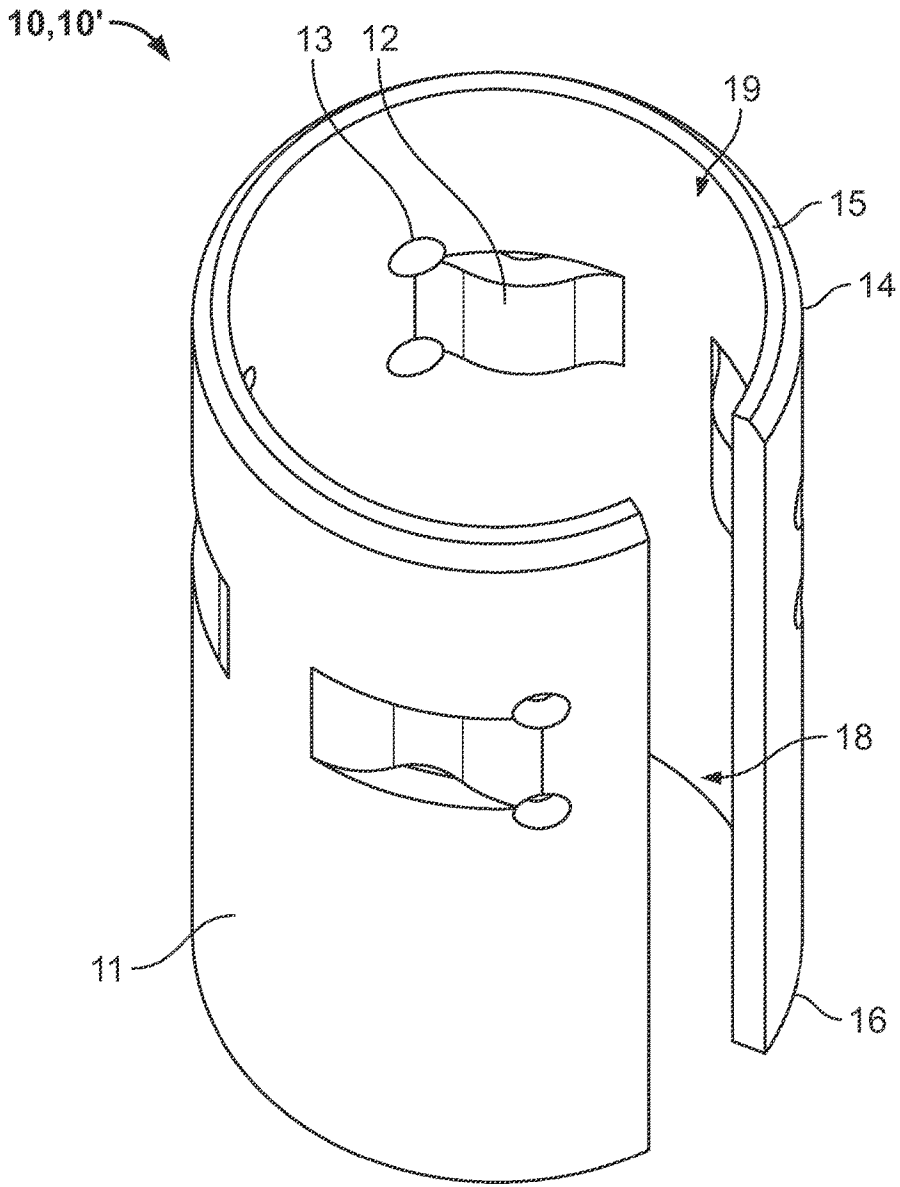
FIG. 2 is a perspective view of a tool retainer or body according to the present disclosure.
Figure 3:
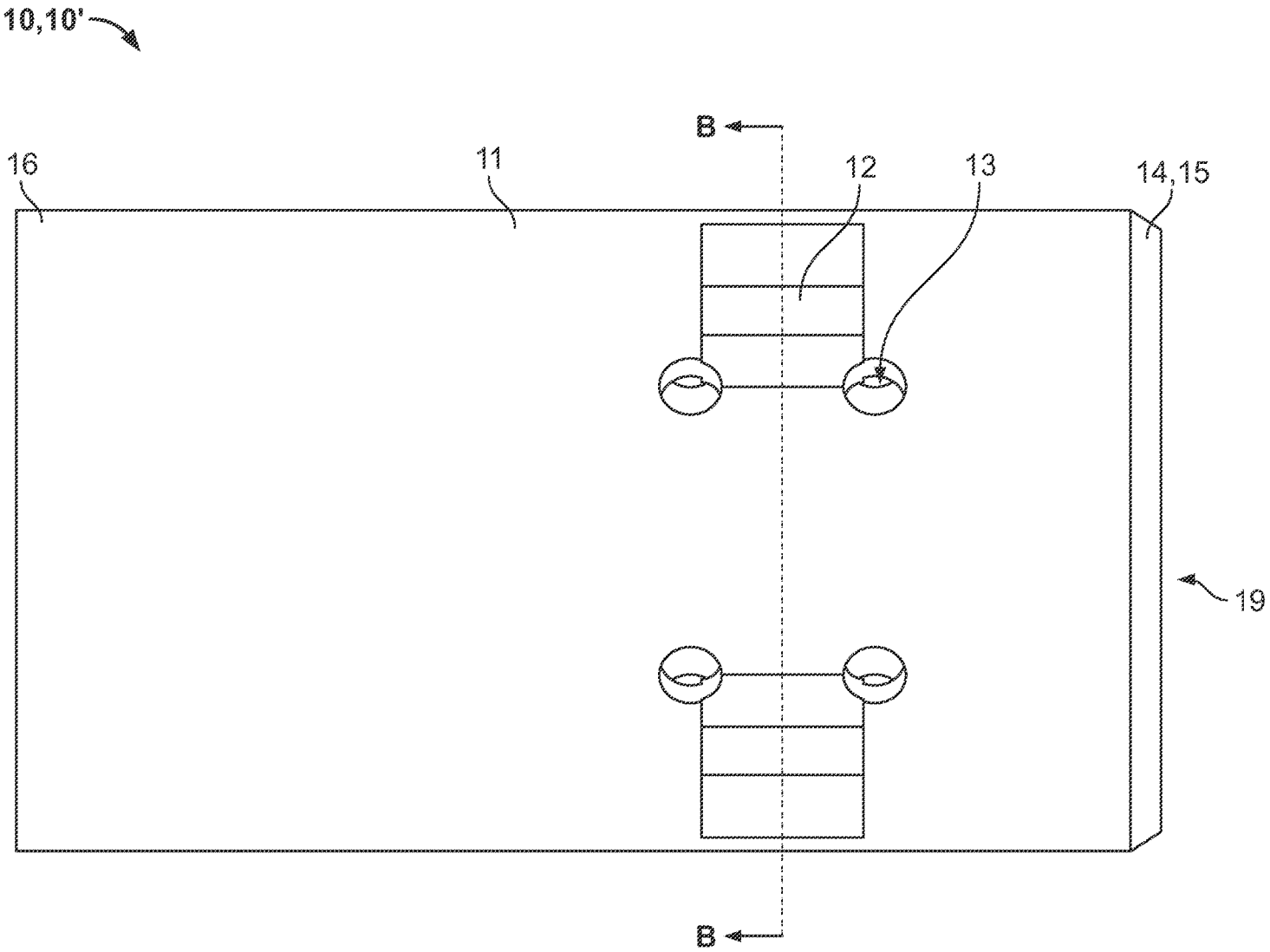
FIG. 3 is a side view of the retainer of FIG. 2.

With reference generally to FIGS. 2 and 3, the retainer 10 is defined substantially by a hollow body or annular wall 11 having a linearly tapering central opening 19. In one embodiment, the annular wall 11 may be of generally constant thickness over a length of the retainer 10. Specifically, in the first or resting state, the retainer 10 is shaped as a conical frustum, have a first end 14 of a first outer and/or inner diameter, and a second end 16 of a second outer and/or inner diameter, distinct from that of the first end (see FIGS. 5 and 6). A slot, slit, or axially extending opening 18 is formed through the annular wall 11, such that the retainer 10 is discontinuous in a circumferential direction along its entire length.

The plurality of bosses 12 (e.g., four) protrude from a remainder of the annular wall 11 and into the opening 19. A plurality of through holes 13 may be formed through the annular wall 11, and more specifically, in one or more corners of each boss 12. The holes 13 may serve as stress or strain relief of the annular wall 11 in the area of initial formation of the bosses 12. One or more of the axial ends 14, 16 of the retainer 10 may define a chamfer or chamfered end surface 15. The chamfer 15 may facilitate the insertion of the retainer 10 into the bore 3 of the holder 2.

In one embodiment, the retainer 10 is manufactured from a sheet of material (e.g., a stamped or punched sheet of stainless steel). The once initially stamped, the material is further formed (e.g., rolled) into the illustrated semi-conical shape. The bosses 12 and through holes 13 may also be created in the retainer 10 via stamping, punching and/or drilling operations performed on the flat sheet prior to formation into the semi-conical profile shown as described herein.

Figure 4B:
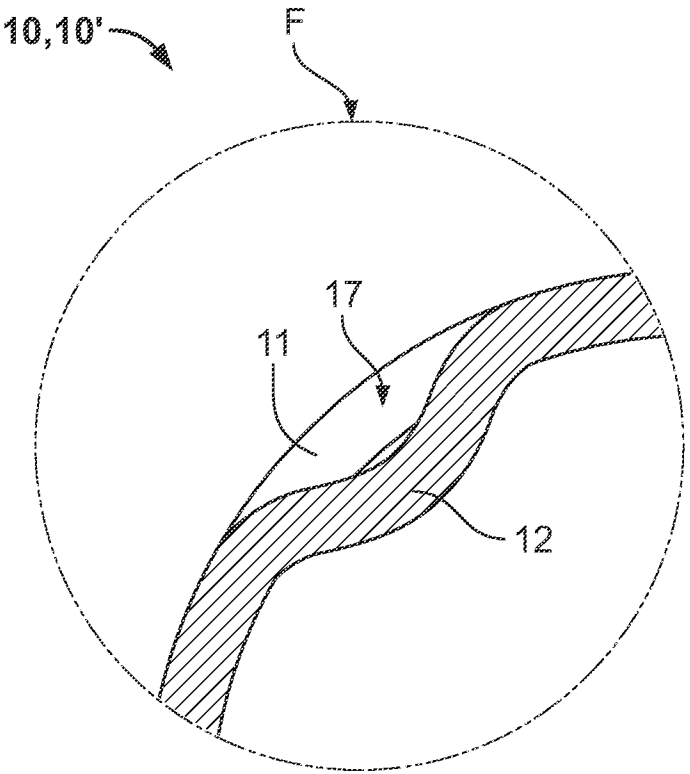
FIG. 4B is a cross-sectional view of the detail F of the retainer shown in FIG. 4A.
Figure 4A:
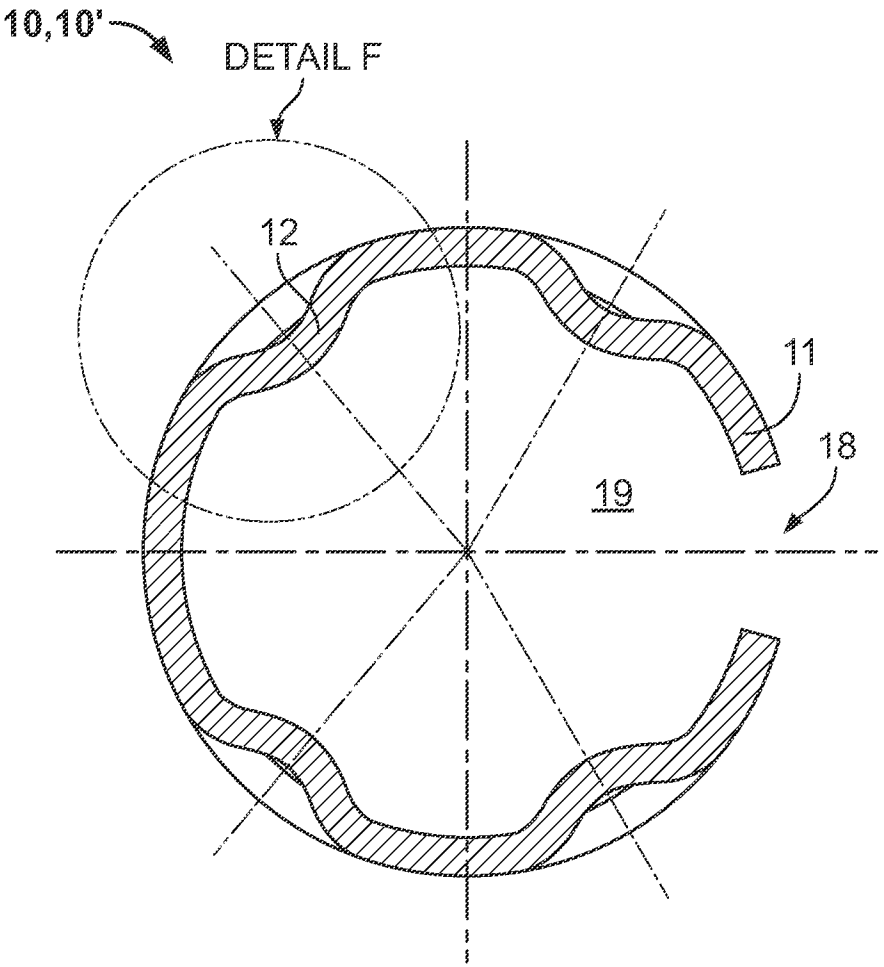
FIG. 4A is a cross-sectional view of the retainer of FIG. 2 taken along section B-B.

Referring now to the cross-sectional view and detailed cross-sectional view of FIGS. 4A and 4B, the protruding bosses 12 are shown in greater detail. As illustrated, each boss 12 may be realized by deforming a portion of the annular wall or body 11 defining the retainer 10. The deformation of the retainer 10 in these areas is operative to create the bosses 12 with a generally arcuate, strip shape, and more specifically to define strips being convex in the radially inward direction. Resultingly, corresponding recesses 17 behind each boss 12 (i.e., on an outward or radially outward facing side of the retainer 10), as shown in detail F of FIG. 4B. Each boss 12 is formed integrally with the annular wall 11 of the retainer 10, and more specifically, remains affixed to the retainer 10 on each end thereof in at least the circumferential direction. In the axial direction, the boss 12 is at least partially detached from the annular wall 11 (e.g., via shearing of the material). The exposed axially facing surfaces of the bosses 12 are adapted (i.e., sized, shaped and located) to oppose surfaces of, for example, the lateral sides of the annular groove 6 of the tool 4 shown in FIG. 1, for securing the tool relative to the retainer 10 in the axial direction(s). In the exemplary embodiment, four bosses 12 are defined by the retainer 10, and are spaced radially from one another relative to a central axis the retainer. However, it should be understood that any number of bosses may be provided without departing from the scope of the present disclosure. In one embodiment, each of the bosses 12 is formed symmetrically in the circumferential direction relative to the central axis of the retainer 10, as can be visualized in FIG. 4A.

Figure 5:
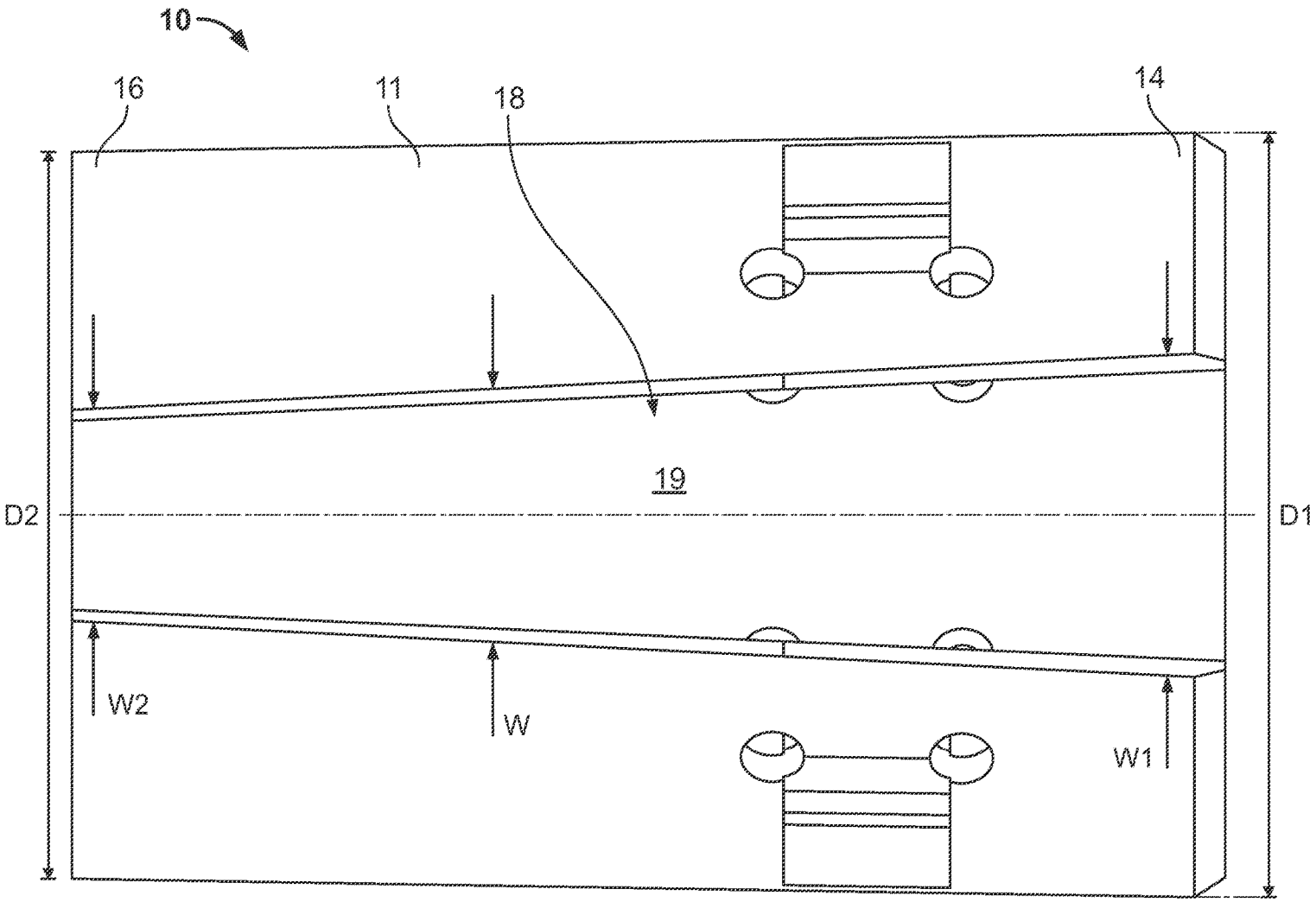
FIG. 5 is a side view of a retainer according to a first embodiment of the present disclosure in a first or resting state.

FIG. 5 is a side view of a first embodiment of the retainer 10 according the present disclosure in the first or resting state, wherein no external forces are acting thereon. In the exemplary embodiment, the first end 14 of the retainer 10 has a first diameter D1 and the second end 16 of the retainer has a diameter D2. It should be understood that the diameters D1, D2 may correspond to an outer diameter of the annular wall 11 of the retainer 10 at each of the ends 14, 16 (assuming a generally constant wall thickness of the annular wall over its length). Likewise, the diameters D1, D2 may correspond to an inner diameter of the annular wall 11 (i.e., the diameter of the opening 19 on respective of the ends 14, 16 of the retainer 10), or to an intermediate or nominal diameter of the annular wall. In the embodiment of the retainer 10 of FIG. 5, the diameter D1 of the first end 14 is greater than the diameter D2 of the second end 16. Likewise, a first width W1 of the slot 18 proximate to or at the first end 14 may be greater than that of a second width W2 of the opening proximate to or at the second end 16, with the opening or slot 18 being defined by two circumferentially-opposing and axially-extending edges. Thus, the slot or opening 18 tapers in a width W relative to a center of the opening (or the central axis A of the retainer 10 and/or the tool assembly). More specifically, in one embodiment, the width W of the opening 18 linearly tapers or reduces in a direction from the first end 14 to the second end 16.

Figure 6:
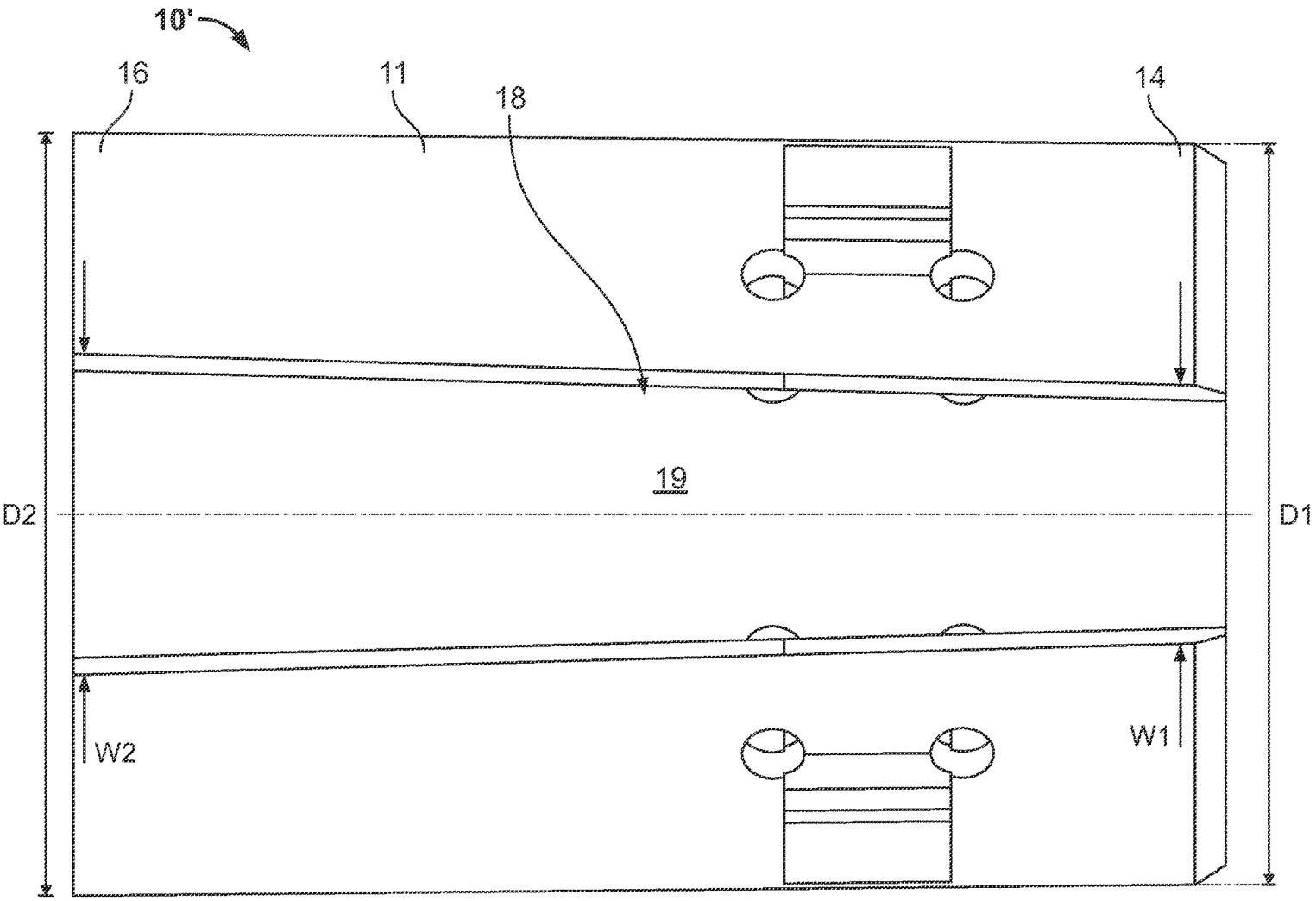
FIG. 6 is side view of a retainer according to a second embodiment of the present disclosure in a first or resting state.

FIG. 6 is a side view of a second embodiment of the retainer 10' according the present disclosure in the first or resting state, wherein no external forces are acting thereon. In the exemplary embodiment, the first end 14 of the annular wall or body 11 has a first diameter D1 (e.g., an inner, outer or nominal diameter) and the second end of the annular wall has a diameter D2. In the embodiment of the retainer 10' of FIG. 6, the diameter D1 of the first end 14 is less than the diameter D2 of the second end 16. Likewise, a first width W1 of the opening 18 on the first end of the body 12 is less than that of a second width W2 of the opening at the second end 16 of the body. The opening 18 tapers in a width W relative to a center of the opening (or the central axis A of the retainer 10'). More specifically, the width W of the opening 18 tapers or reduces in a direction from the second end 16 to the first end 14.

In operation, the embodiments of the retainer 10, 10' of FIGS. 5 and 6 provide distinct characteristics. For example, as will be set forth in greater detail herein with respect to FIGS. 8-10, the retainer 10 is advantageous in that, as the first end 14 is expanded proximate the first end 14 the holding force generated by the retainer 10 is generally maintained during its removal. More specifically, with the retainer 10 and tool 4 in an installed position (see FIG. 1), retaining force generated between the retainer and the holder 2 is maintained while the retainer and the tool are axial translated in a removal direction (either intentionally or unintentionally). In this way, inadvertent relative axial movement between the holder 2, and the retainer 10 and tool 4, will not significantly or abruptly decrease the holding force of the retainer, and removal of the tool is more consistently resisted. However, as the first end 14 of the retainer 10 comprises a diameter D1 greater than that of the bore 3 of the holder 2, introducing the retainer into the bore requires that the retainer be compressed radially inward. This may be achieved manually (i.e., via placing sufficient force on the retainer in the axial insertion direction), or via the use of a compression element 8, such as the washer, as described herein.

In the embodiment of FIG. 6, however, as the second end 16 of the retainer 10' is expanded relative to the first end 14, the holding force of the retainer more quickly decreases as the retainer is translated in a removal direction relative to the holder 2. This has the benefit of easing removal operations of the retainer 10' and tool 4 from the holder 2. Likewise, as the first end 14 has a reduced diameter relative to the second end, it may be easier to at least initially install the retainer 10' into the holder 2 (i.e., the first diameter D1 may be less than a diameter of the bore 3). As a result, no supplemental compression element (e.g., a compressor washer) may be needed to facilitate the initial insertion of the retainer 10' into the holder 2.

Figure 7:
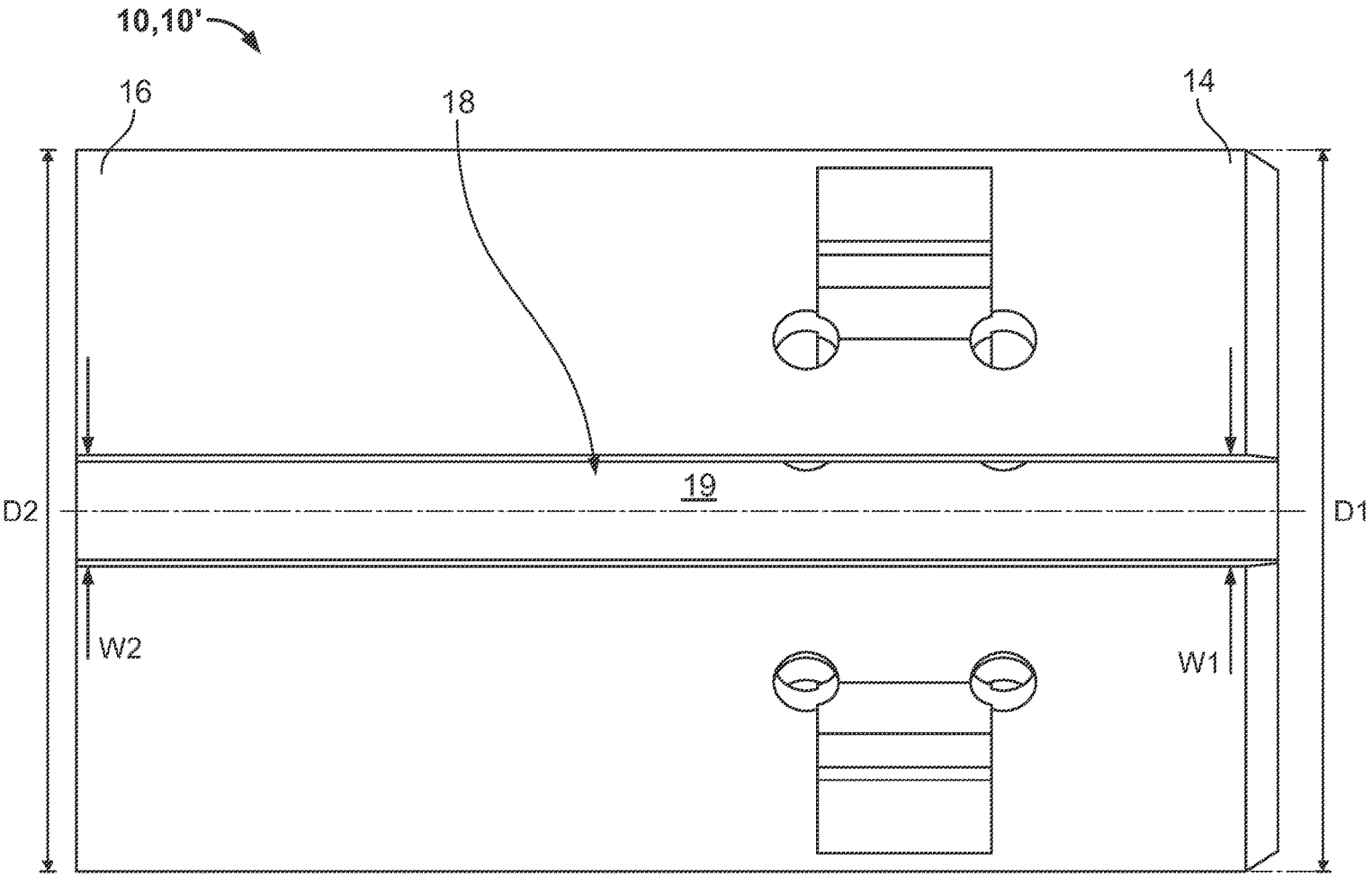
FIG. 7 is a side view of the retainer of FIG. 5 and/or FIG. 6 in a second or elastically deformed state.

FIG. 7 illustrates the retainer 10, 10' as it may appear after insertion into the bore 3 of the holder 2. As shown, with the bore 3 having a generally cylindrical (i.e., non-tapering) inner profile, the diameters D1 and D2 of the first and second ends of the retainer 10, 10' may be generally equal. It should be understood, however, that retention forces generated by the expansion of the retainer 10, 10' are different at each end thereof, depending on which embodiment of the retainer 10, 10' is utilized. In the embodiment of the retainer 10 of FIG. 5, the retention force generated thereby is greatest proximate the first end 14, and decreases (e.g., linearly) approaching the second end 16. Oppositely, in the embodiment of the retainer 10' of FIG. 6, the retention force is greatest proximate the second end 16, and decreases approaching the first end 14. In the exemplary embodiments, in the installed or elastically compressed state, the widths W1 and W2 of each end of the slot 18 may be generally equal.

Figure 8:
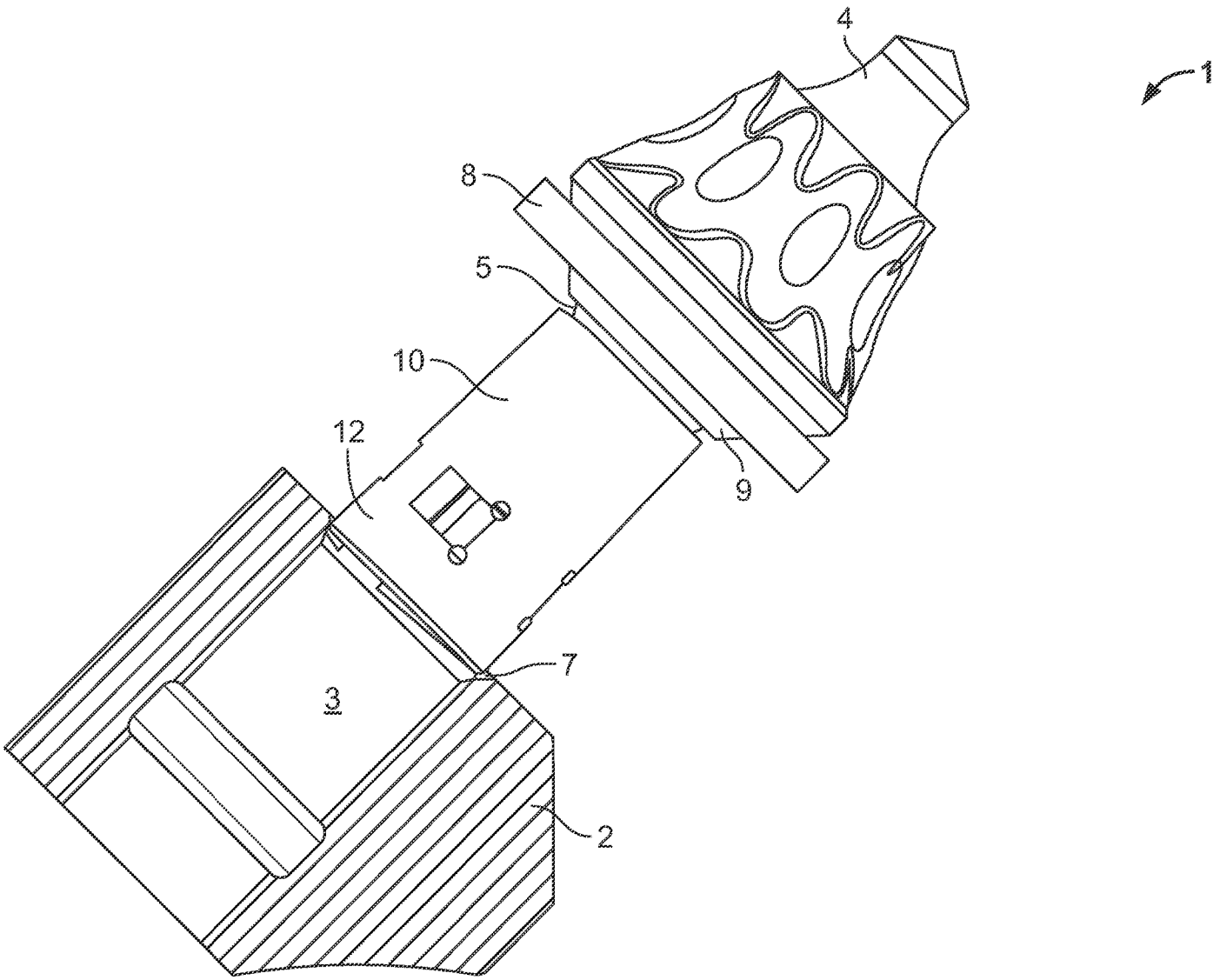
FIG. 8 is another partial cross-sectional view of the tool assembly of FIG. 1 with the tool and the retainer shown in a pre-installation state.

Referring now to FIGS. 1 and 8-10, an installation processes of the tool subassembly including the retainer 10 according to the first embodiment of the present disclosure will be provided. With reference to FIG. 8, the tool subassembly including the tool 4, the retainer 10 and the compression element 8 are shown in a first configuration, wherein the compression element is not engaged with (i.e., sleeved over) the retainer. More specifically, the compression element 8 is arranged over an annular neck 40 of the tool 4 (see FIG. 9), and does not contact the retainer 10. In this resting state of the retainer 10, the first end 12 thereof has a diameter (i.e., diameter D1 of FIG. 5) that is greater than an inner diameter of the bore 3 of the tool holder 2. In this way, the retainer 10 is prevented from being inserted, or easily inserted, into the bore 3 of the tool holder 2.

Figure 9:
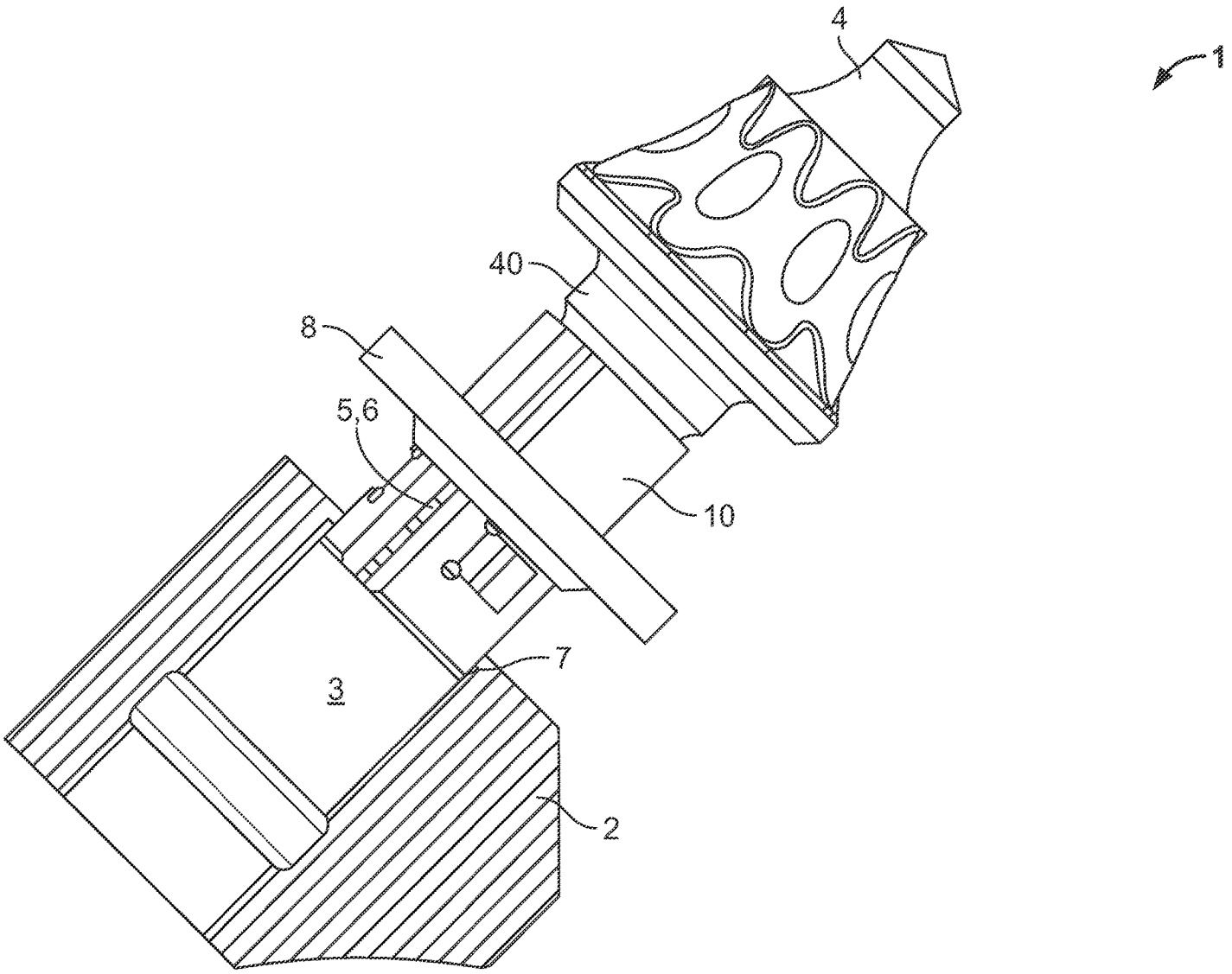
FIG. 9 is another partial cross-sectional view of the tool assembly of FIGS. 1 and 8 illustrating the retainer and tool as they are initially inserted into the tool holder.

With reference to FIG. 9, in order to aid in the installation of the tool subassembly, the compression element 8 is axially translated over the retainer 10 to a position in which the first end 14 of the retainer is insertable into the bore 3. More specifically, an inner diameter of the compression element 8 is less than an outer diameter D1 of at least the first end 14 of the retainer 10, and in one embodiment, of each of the first end 14 and the second end 16 of the retainer 10. In this way, as the compression element 8 is translated toward the first end 14, the outer diameter D1 of the retainer 10 at the first end is reduced. Sufficient reduction of the outer diameter of the retainer 10 at the first end 14 enables its insertion into the bore 3. This initial insertion of the retainer 10 may be aided by the presence of a chamfer 7 formed on an end of the bore 3.

Figure 10:
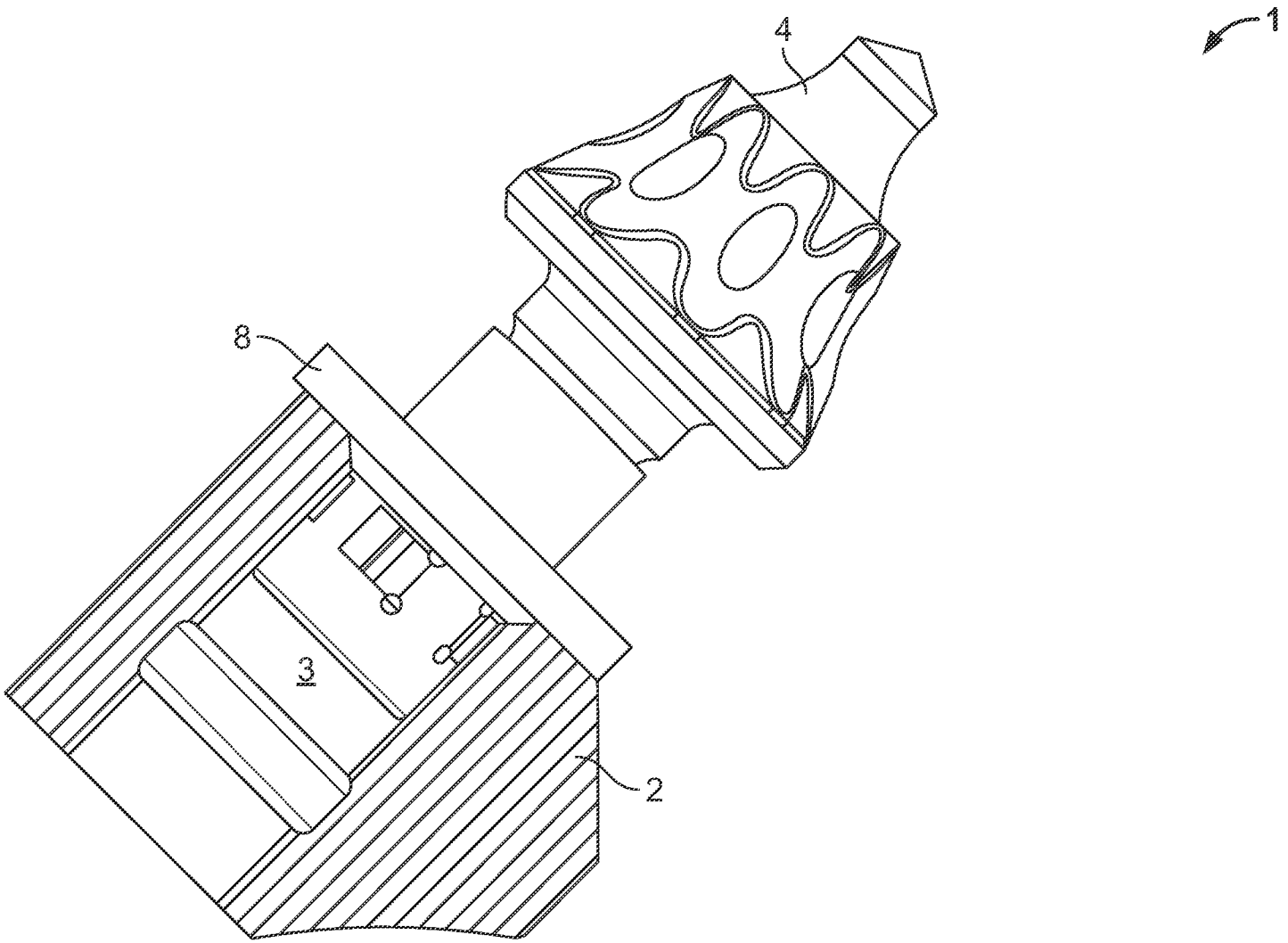
FIG. 10 is another partial cross-sectional view of the tool assembly of FIGS. 1, 8 and 9, with the retainer and tool further inserted into the tool holder.

With reference to FIGS. 9 and 10, once the retainer 10 has been initially introduced into the bore 3 of the holder 2, the tool 4 may be biased toward an installed position in the axial direction. As the retainer 10 slides along the bore 3, the compression element 8 abuts the holder 2. Continued translation of the tool subassembly biases the retainer 10 further into the bore 3, and the compression element 8 further along the retainer toward the working end of the tool 4, until the tool is fully seated in the holder 2 and the compression element is biased either completely passed the retainer or at least sufficiently toward the second end 16 thereof, as shown in FIG. 1. In some embodiments, the compression element 8 defines a chamfered protruding end 9 corresponding to the chamfer 7 of the bore 3, thus aiding in the coaxial alignment of the tool subassembly relative to the holder 2, as shown in FIGS. 1 and 10.

It should be understood that embodiments of the present disclosure include a preassembled tool subassembly, including the tool 4 fitted with the retainer 10 and the compression element 8. These subassemblies may be installed by a user during initial assembly, or subsequent maintenance, of road planing or milling equipment, by way of nonlimiting example.

In addition, those areas in which it is believed that those of ordinary skill in the art are familiar, have not been described herein in order not to unnecessarily obscure the invention described. Accordingly, it has to be understood that the invention is not to be limited by the specific illustrative embodiments, but only by the scope of the appended claims.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of the elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A retainer for a tool, comprising:

an annular body defining a central opening adapted to receive a tool therein in an axial direction and including a first end having a first external diameter, and a second end having a second external diameter;

a plurality of protruding bosses extending into the opening from an internal side of the body defining the central opening; and a slot formed through the body and extending in the axial direction between the first end and the second end, wherein:

in a resting state of the body, the first external diameter and the second external diameter are distinct from one another;

the body is elastically deformable into a compressed state wherein the first external diameter and the second external diameter are equal;

in the resting state, a width of the slot tapers between the first end of the body and the second end of the body in the axial direction; and in the compressed state of the body, the width of the slot is generally constant between the first and second ends of the body.

2. The retainer of claim 1, wherein the plurality of protruding bosses are arranged proximate the first end of the body.

3. The retainer of claim 1, wherein, in the resting state of the body, the first external diameter of the first end of the body is greater than the second external diameter of the second end of the body.

4. The retainer of claim 3, wherein, in the resting state of the body, a first width of the slot in a circumferential direction at the first end of the body is greater than a second width of the slot in the circumferential direction at the second end of the body.

5. The retainer of claim 4, wherein, in the resting state of the body, the width of the slot tapers linearly from the first end of the body to the second end of the body.

6. The retainer of claim 2, wherein, in the resting state of the body, the first external diameter of the first end of the body is less than the second external diameter of the second end of the body.

7. The retainer of claim 6, wherein, in the resting state of the body, a first width of the slot in a circumferential direction at the first end of the body is less than a second width of the slot at the second end of the body.

8. The retainer of claim 7, wherein, in the resting state of the body, the width of the slot tapers linearly from the second end of the body to the first end of the body.

9. The retainer of claim 2, wherein plurality of protruding bosses are spaced circumferentially about the center opening.

10. The retainer of claim 1, wherein the annular body defines a generally constant thickness in a radial direction.

11. The retainer of claim 1, wherein the annular body is generally shaped as a conical frustum.

12. A tool subassembly, comprising:

a tool retainer, including:

an annular body defining a central opening adapted to receive a tool therein in an axial direction and including a first end having a first external diameter, and a second end having a second external diameter;

a plurality of protruding bosses extending into the central opening from an internal side of the body defining the central opening; and a slot formed through the body and extending in the axial insertion direction between the first end and the second end, wherein:

in a resting state of the body, the first external diameter and the second external diameter are distinct from one another;

the body is elastically deformable into a compressed state wherein the first external diameter and the second external diameter are equal;

in the resting state, a width of the slot tapers between the first end of the body and the second end of the body in the axial direction; and in the compressed state of the body, the width of the slot is generally constant between the first and second ends of the body; and a compression element defining an opening adapted to receive the tool retainer, the opening having an internal dimension less than the first external diameter of the annular body, the compression element adapted to elastically deform the first end of the retainer in a radially inward direction as the compression element is translate over the retainer from the second end toward the first end.

13. The tool subassembly of claim 12, wherein the internal dimension of the opening of the compression element is less than the second external diameter of the annular body.

14. The tool subassembly of claim 12, further comprising a tool having a shank inserted into the retainer, the shank defining an annular groove receiving the plurality of protruding bosses.

15. A tool assembly, comprising:

a tool holder defining a bore extending therein;

a tool having a shank;

a tool retainer fitted over the shank, including:

an annular body defining a central opening receiving the tool therein in an axial direction and including a first end having a first external diameter, and a second end having a second external diameter;

a slot formed through the body and extending in the axial direction between the first end and the second end, wherein:

in a resting state of the body, the first external diameter and the second external diameter are distinct from one another;

the body is elastically deformable into a compressed state wherein the first external diameter and the second external diameter are equal;

in the resting state, a width of the slot tapers between the first end of the body and the second end of the body in the axial direction; and in the compressed state of the body, the width of the slot is generally constant between the first and second ends o the body; and a compression element defining an opening adapted to receive the tool retainer, the opening having an internal dimension less than the first external diameter of the annular body.

16. The tool assembly of claim 15, wherein the internal dimension of the compression element is less than or equal to a diameter of the bore of the tool holder.

17. The tool assembly of claim 16, wherein the internal dimension of the compression element is less than that of the second external diameter of the second end of the body.

18. The tool assembly of claim 15, wherein the retainer further includes a plurality of protruding bosses extending into the central opening from an internal side of the body defining the central opening, the plurality of bosses engaging with an annular groove formed in the shank of the tool.

19. The tool assembly of claim 15, wherein, with the retainer and the tool received within the bore, the first end of the body applies a first holding force on the tool holder and the second end of the body applies a second holding force on the tool holder distinct from the first holding force.

* * * * *